US007810885B2

(12) United States Patent
Chen et al.

(10) Patent No.: US 7,810,885 B2
(45) Date of Patent: Oct. 12, 2010

(54) SINGLE-HAND HEIGHT ADJUSTMENT MECHANISM OF HIGHCHAIR

(75) Inventors: Shunmin Chen, Taipei (TW); Hongbin Xu, Taipei (TW); Xiaohong Xiao, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 196 days.

(21) Appl. No.: 12/178,644

(22) Filed: Jul. 24, 2008

(65) Prior Publication Data

US 2009/0045656 A1 Feb. 19, 2009

(30) Foreign Application Priority Data

Aug. 14, 2007 (CN) ..... 2007 2 0127372 U

(51) Int. Cl.
*A47C 1/031* (2006.01)
*A47C 3/20* (2006.01)

(52) U.S. Cl. ..... 297/344.18

(58) Field of Classification Search ..... 297/344.12, 297/344.18, 344.15
See application file for complete search history.

(56) References Cited

U.S. PATENT DOCUMENTS 5,445,432 A * 8/1995 Chien ..... 297/344.18
5,468,051 A * 11/1995 Huang ..... 297/344.18 X
6,951,371 B2 * 10/2005 Wang ..... 297/344.18 X
7,568,758 B2 * 8/2009 Troutman et al. ..... 297/148

* cited by examiner

*Primary Examiner*—Anthony D Barfield

(57) ABSTRACT

A Single-hand height adjustment mechanism of a highchair includes an operating unit handled with a single hand, and a locking unit connected with the operating unit. The operating unit uses simple movement, such as handle pressing or button pulling, to pull adjustment wires. The adjustment wires then activate or release the locking unit. Therefore, the seat can be adjusted to higher or lower positions with the use of a single hand.

15 Claims, 13 Drawing Sheets

SINGLE-HAND HEIGHT ADJUSTMENT MECHANISM OF HIGHCHAIR

BACKGROUND OF THE INVENTION

1. Field of the Invention

The present invention relates to a height adjustment mechanism of a highchair operated by a single hand, and in particular to an adjustment mechanism having a single-hand operating unit and a locking unit. It simply presses a handle or pulls a button of the operating unit to actuate the locking unit, thereby achieving height adjustment of the highchair with a single hand.

2. The Prior Arts

The disadvantage of an adjustment mechanism of a conventional highchair, such as the ones disclosed in U.S. Pat. Nos. 6,951,371 and 6,050,643, is that the adjusting and locking mechanism are manually operated with both hands, so the usability is greatly decreased. Moreover, it is likely to have an incomplete locking and unlocking conditions, which causes inappropriate positioning of the seat or jamming of moveable parts of adjusting and locking mechanism.

On the other hand, the height of the highchair has to be adjusted according to the child's height or the height of the table frequently. Therefore, there is a practical need for a reliable height-adjustable highchair. Compared with a highchair disclosed in U.S. Pat. No. 6,161,898, a highchair according to the present invention provides a height adjustment mechanism that is simple, convenient, safe, and easy to use.

SUMMARY OF THE INVENTION

A primary objective of the present invention is to provide an adjustment mechanism having a single-hand operating unit and a locking unit, which is convenient to adjust the height of the seat with a single hand.

A primary characteristic of the single-hand height adjustment mechanism of a highchair according to the present invention is that the mechanism can quickly and easily adjust the height of the seat with one single hand. The mechanism also provides a quick positioning feature.

In order to achieve the objective and characteristic mentioned above, the improvements of the present invention include:

A handle-type operating unit includes two adjustment gears enclosed in a height adjusting housing and a handle. The handle is connected with the two adjustment gears and each of the adjustment gears is connected with an adjustment wire. Also, the height adjusting housing includes a front housing and a rear housing.

A linear locking unit includes height positioning members, pins, fixing members, and springs, which are all disposed inside a seat positioning tube, and height adjustment members disposed outside of the seat positioning tube. The seat positioning tube is connected with the height adjustment member. Further, the positioning member is a board piece, and is provided with an inclining surface at the front end thereof The positioning member is assembled with the fixing member by means of the pin. The fixing member and the spring are contacted with each other and the fixing member is connected with the adjustment wire of the handle-type operating unit.

A connecting member can be a metal wire for driving the mechanism or be made of other material with the similar quality.

Supporting tubes include front legs and rear legs for supporting the chair. Further, the front legs are provided with a plurality of positioning holes. The front legs and rear legs are made of tubes, and are provided with wheels at the bottom thereof The seat is an integrally formed seat body. The bottom of the seat is fixed with the seat positioning tube and both sides of the seat are connected with the height adjustment member. Two rivets are disposed in the seat body.

A leg joint is a V-shaped tube joint connecting the front leg with the rear leg.

Furthermore, the handle-type operating unit mentioned above can be connected with a twisting locking unit. The twisting locking unit includes fixing members, bolts, torsion springs, and positioning members, which are all disposed inside of a height adjustment member, and a seat positioning tube disposed outside of the height adjustment members. Also, the positioning member is a board piece, and is provided with an inclining surface at the front end thereof. The positioning member is connected with the fixing member, which uses the bolt as a rotating pivot. Further, the bolt is engaged with the torsion spring, whose one end is connected with the fixing member and the other end is fixed on the height adjustment member. Also, the fixing member is connected with the adjustment wire of the handle-type operating unit.

The handle-type operating unit mentioned above can be connected with a slanting locking unit. The slanting locking unit includes positioning members, pins, fixing members, and springs, which are all disposed inside of a seat positioning tube, and height adjustment members, a driving member and a driving member cover, which are all disposed outside of the seat positioning tube. The seat positioning tube is assembled with the height adjustment members. Further more, the positioning member is a board piece, and is provided with an inclining surface at the front end thereof. The positioning member is assembled with the fixing member by means of the pin. The fixing members at both sides of the seat are respectively contacted with the two ends of the spring. The side of the fixing member closed to the spring is provided with the pin that is inserted in a slant groove of the driving member. The two ends on top of the driving member are connected with the connecting member of the handle-type operating unit. Also, the driving member is covered by the driving member cover.

Moreover, the above handle-type operating unit can be replaced by a button-type operating unit which can be connected with one of the linear locking unit, the twisting locking unit, and the slanting locking unit. The button-type operating unit is provided with a button disposed on the seat back of the seat. The button is connected with a connecting member for driving the locking unit, such as the linear locking unit, the twisting locking unit, and the slanting locking unit, to actuate or release the locking unit. Also, a spring is disposed beneath the button for returning the button to the original position after the button is released.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
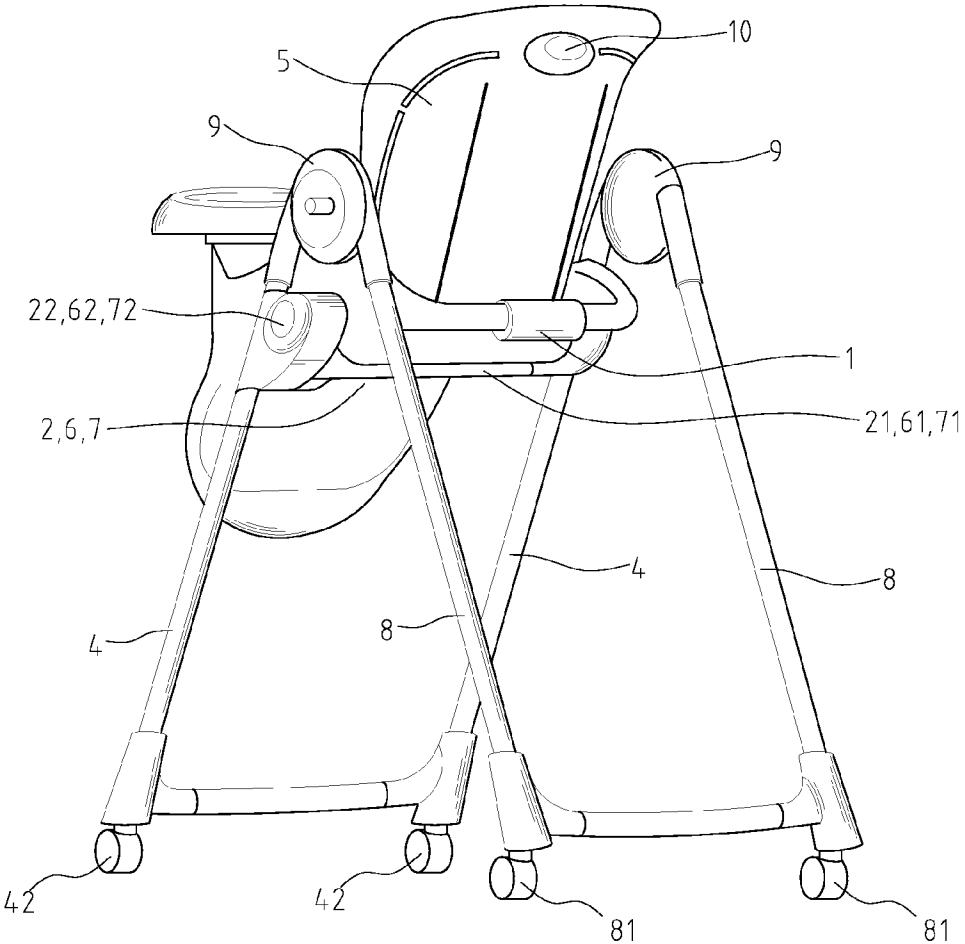
FIG. 1 is a perspective view showing a highchair having a single-hand height adjustment mechanism according to the present invention.
Figure 11:
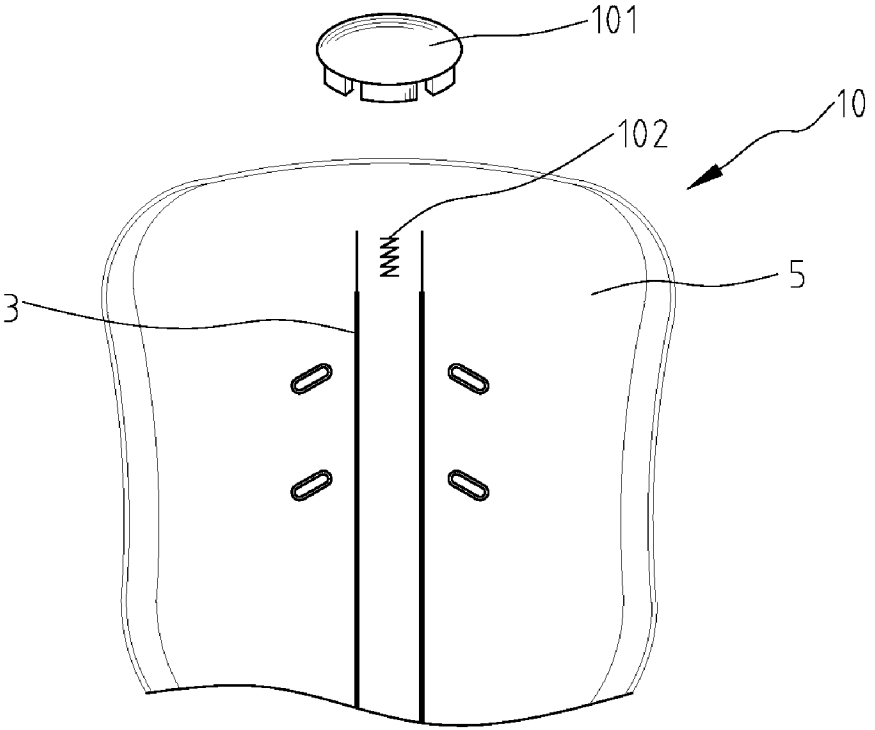
FIG. 11 is an exploded perspective view showing an operating unit according to another embodiment of the present invention.

With reference to FIGS. 1 and 11, a highchair having a single-hand height adjustment mechanism according to the present invention includes an operating unit and a locking unit. The operating unit can be a handle-type operating unit 1 or a button-type operating unit 10. A handle or a button is an operating member to control the locking unit. Furthermore, the locking unit can be a linear locking unit 2, a twisting locking unit 6, or a slanting locking unit 7. The operating unit and the locking unit have several feasible combinations described as follows:

(1) a first embodiment: the handle-type operating unit 1 and the linear locking unit 2; (2) a second embodiment: the handle-type operating unit 1 and the twisting locking unit 6; (3) a third embodiment: the handle-type operating unit 1 and the slanting locking unit 7; (4) another embodiment: the button-type operating unit 10 and any one of the linear locking unit 2, the twisting locking unit 6 and the slanting locking unit 7.

Referring to FIG. 1, a seat 5 is assembled with front legs 4 by means of seat positioning tubes 21, 61, 71 and height adjustment members 22, 62, 72 according to the first, second, and third embodiment, respectively. The front legs 4 are assembled with rear legs 8 by means of leg joints 9. Also, front wheels 42 are mounted at the bottom of the front legs 4 and rear wheels 81 are mounted at the bottom of the rear legs 8.

Figure 2:
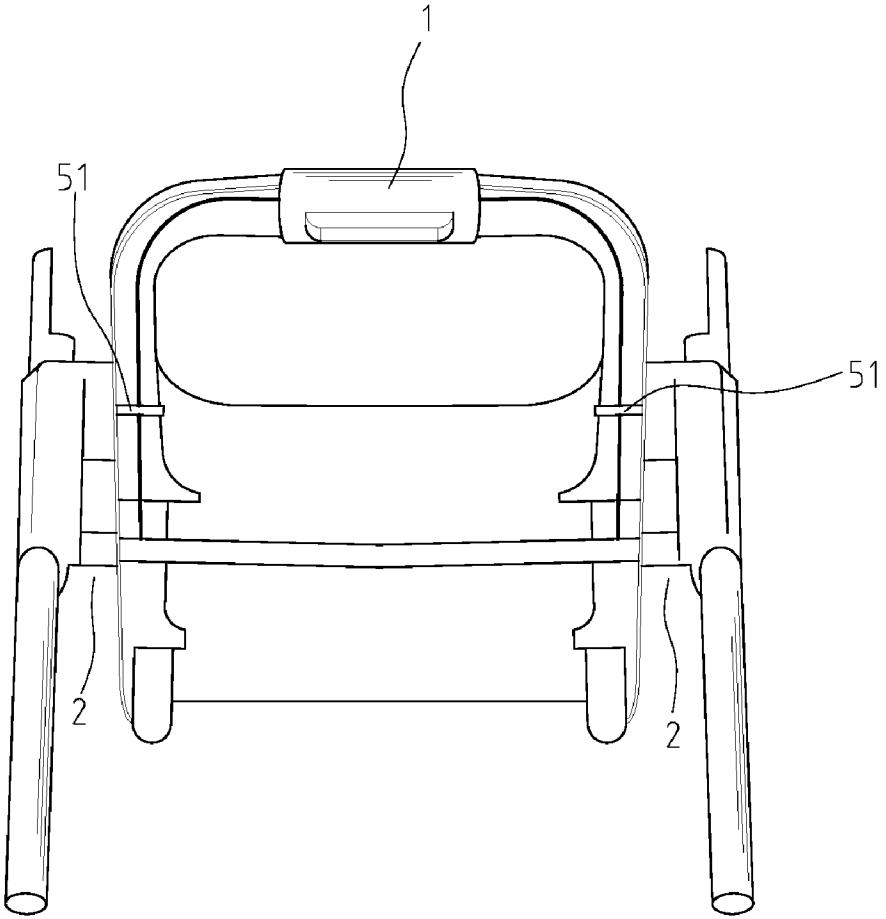
FIG. 2 is a schematic perspective view showing the height adjustment mechanism according to a first embodiment of the present invention.

With reference to FIG. 2, the height adjustment mechanism of the highchair according to the first embodiment of the present invention comprises the handle-type operating unit 1 and the linear locking unit 2.

Figure 3:
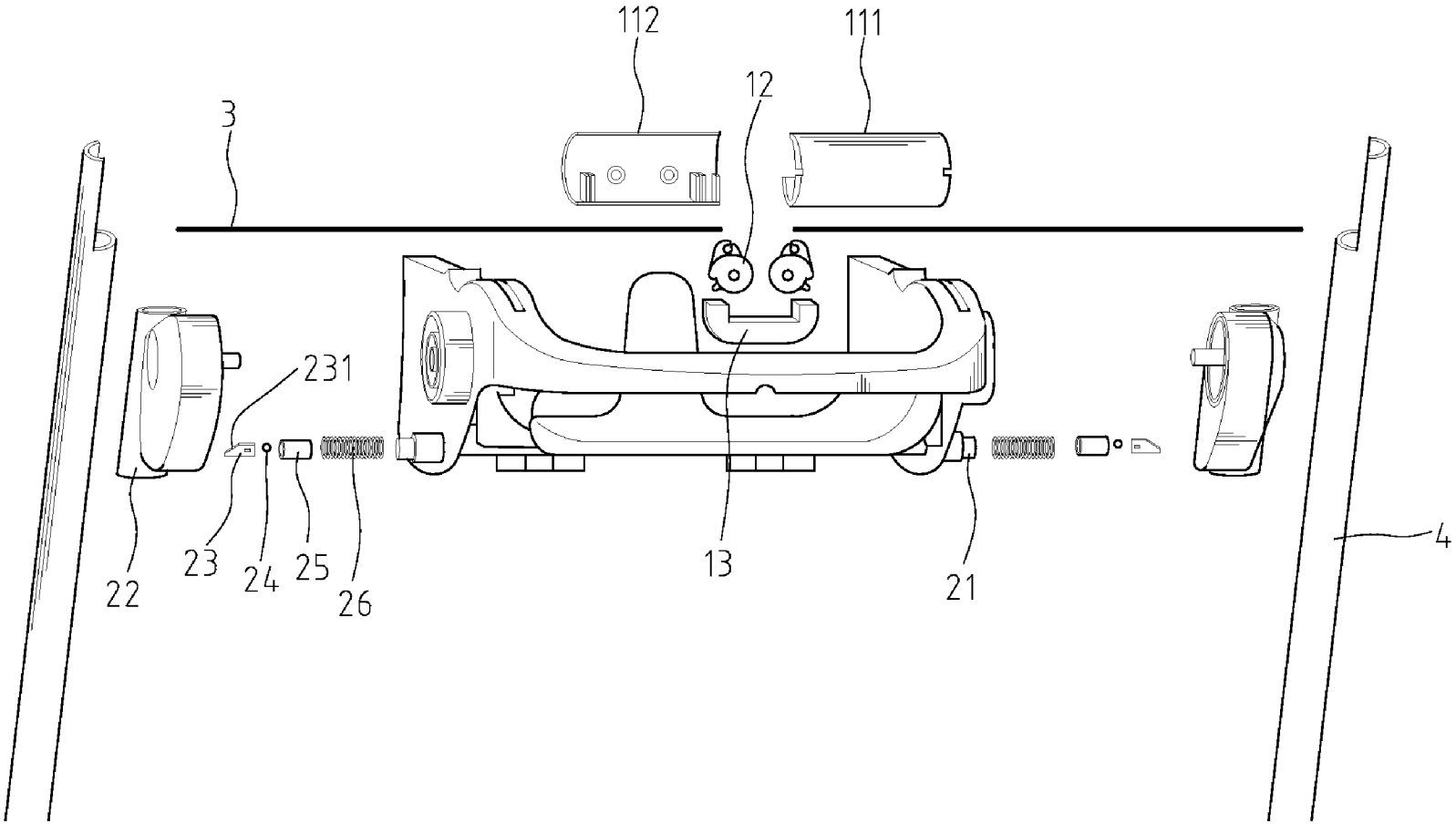
FIG. 3 is an exploded perspective view showing the height adjustment mechanism according to the first embodiment of the present invention.
Figure 4:
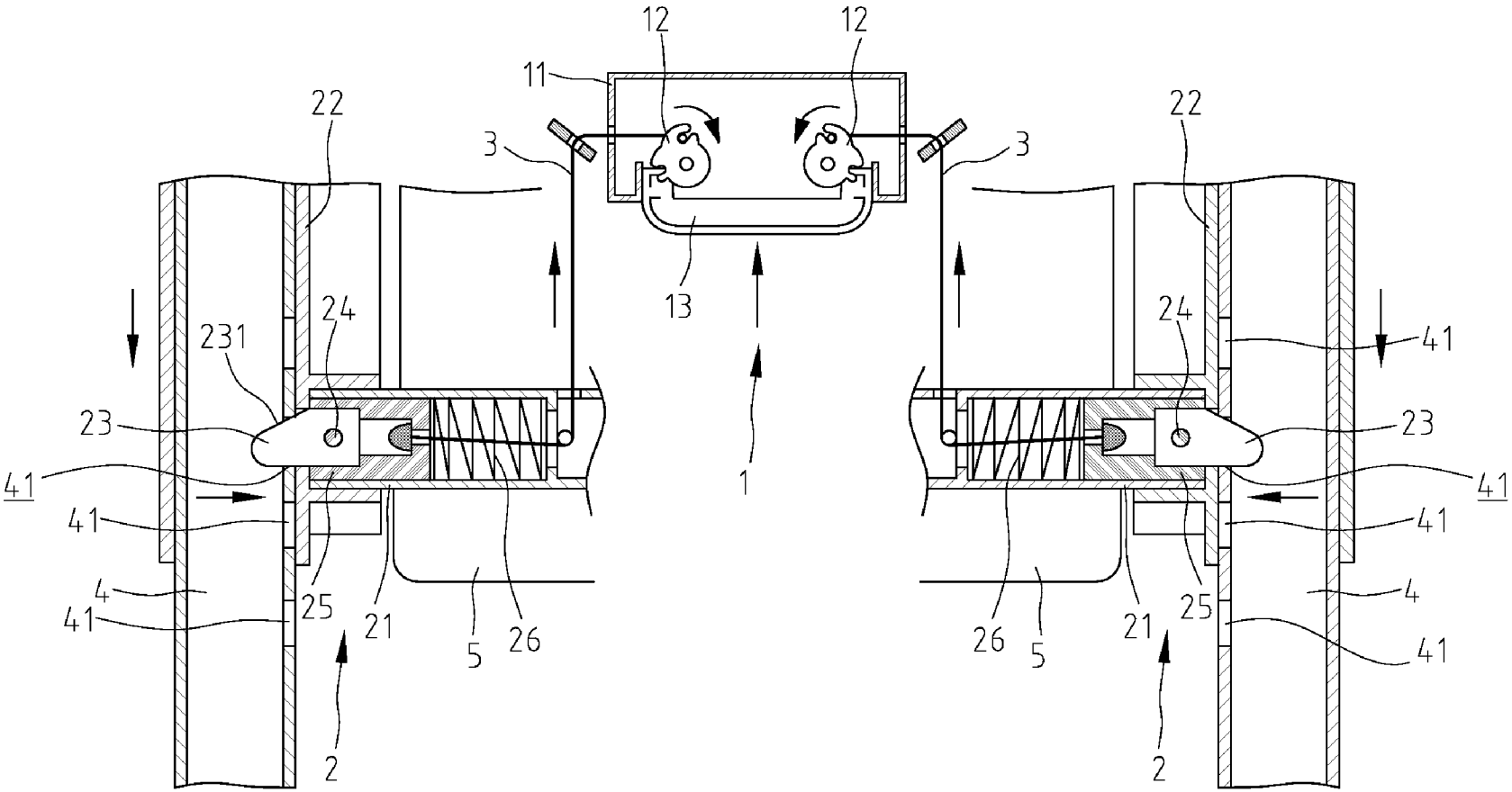
FIG. 4 is a cross-sectional view showing an unlocking process of the height adjustment mechanism according to the first embodiment of the present invention.

FIGS. 3 and 4 show the height adjustment mechanism of a highchair according to the first embodiment of the present invention. The handle-type operating unit 1 includes a height adjusting housing 11 having a front housing 111 and a rear housing 112, adjustment gears 12, and a handle 13. Also, the linear locking unit 2 includes a seat positioning tube 21, height adjustment members 22, positioning members 23, pins 24, fixing members 25, and springs 26. The handle-type operating unit 1 is connected with the linear locking unit 2 by adjustment wires 3 and the height adjustment member 22 is movably connected with the front leg 4 to let the seat 5 to glide up and down.

With reference to FIG. 4, the handle-type operating unit 1 includes the two adjustment gears 12 disposed in the height adjusting housing 11, and the handle 13. Further, the handle 13 is connected with the adjustment gears 12 and each of the adjustment gears 12 is connected with the adjustment wire 3. The height adjusting housing 11 comprises the front housing 111 and the rear housing 112. Moreover, the linear locking unit 2 comprises the seat positioning tube 21, the positioning members 23, the pins 24, the fixing members 25, the springs 26, and the height adjustment members 22. The positioning members 23, the pins 24, the fixing members 25, and the springs 26 are disposed inside of the seat positioning tube 21, and the height adjustment members 22 are disposed outside of the seat positioning tube 21. The seat positioning tube 21 is disposed between the height adjustment members 22. Further, the positioning member 23 is a board piece and is provided with an inclining surface at the front end thereof. The positioning member 23 is connected with the fixing member 25 by means of the pin 24. The fixing member 25 is contacted with the spring 26 and is connected with the other end of the adjustment wire 3 coming from the handle-type operating unit 1. The adjustment wire 3 is a steel cord for driving the mechanism to move. The front leg 4 of the chair is a tube which has a plurality of positioning holes 41 at the side thereof and the wheel 42 at the bottom thereof, and the rear leg 8 of the chair is a tube equipped with the wheel 81 at the bottom. The seat 5, which is an integrally formed seat body, is mounted to the seat positioning tube 21 at the bottom thereof and connects with the height adjustment members 22 at lateral sides thereof. Furthermore, two rivets 51 are disposed in the seat body of the seat 5 (with reference to FIG. 2). The leg joint 9 is a V-shaped joint to connect the front leg 4 with the rear leg 8.

Referring to FIG. 4, the way to adjust the seat 5 to a lower position by using the mechanism mentioned above, the handle 13 of the handle-type operating unit 1 is pressed inward firstly, the handle 13 drives the adjustment gears 12 to rotate. The adjustment wires 3 connected with the adjustment gears 12 are driven to move inward by the rotation of the adjustment gears 12, each adjustment wire 3 connects the fixing member 25 at another end after passing the rivet 51 in the seat 5 (with reference to FIG. 2), so as to pull the fixing members 25 inward. The positioning members 23 connected with the fixing members 25 by means of the pins 24 are pulled inside the seat positioning tube 21 and compress the springs 26 at the same time, thereby temporarily disengaging the positioning members 23 from the positioning holes 41 of the front legs 4. Therefore, the seat 5 can be adjusted to a lower position. When the seat 5 has been moved to the other position, release the press on the handle 13 so that the driven adjustment wires 3 are also released. The springs 26 resume to their original state and push the positioning members 23 back to the positioning holes 41 of the front legs 4, thereby engaging the positioning members 23 with the front legs 4. Therefore, the height adjustment to a lower position of the seat 5 is completed. At the moment, the positioning members 23 are engaged into the positioning holes 41, the adjustment wires 3 are pulled by the positioning members 23, the adjustment gears 12 are rotated by the wires 3 and the handle 13 are driven by the adjustment gears 12 back to the original unpressed state. When adjusting the seat 5 to a higher position, the only thing needed is to raise the seat 5 upward directly without pressing the handle 13. When the seat is in a locking state, the positioning members 23 engage with the positioning holes 41 and the rims of the engaging positioning holes 41 are contacted with the surfaces of the positioning members 23. When the seat 5 is going to be raised, the positioning members 23 are subjected to reaction forces in the contact of the rims of the positioning holes 41 and the inclining surfaces of the positioning members 23. For the sake of the reaction forces, the positioning members 23 glide back into the seat positioning tube 21 and the springs 26 are compressed. Thus, the positioning members 23 temporarily disengage from the positioning holes 41 of the front legs 4 and the seat 5 is free to move. When the positioning members 23 is raised to the positioning holes 41 at a higher position, the springs 26 resume to the original state and push the positioning members 23 into to the positioning holes 41. Thus, the positioning members 23 engage with the positioning holes 41 of the front legs 4 again. Therefore, it completes the height adjustment of the seat 5 to a higher position.

Figure 5:
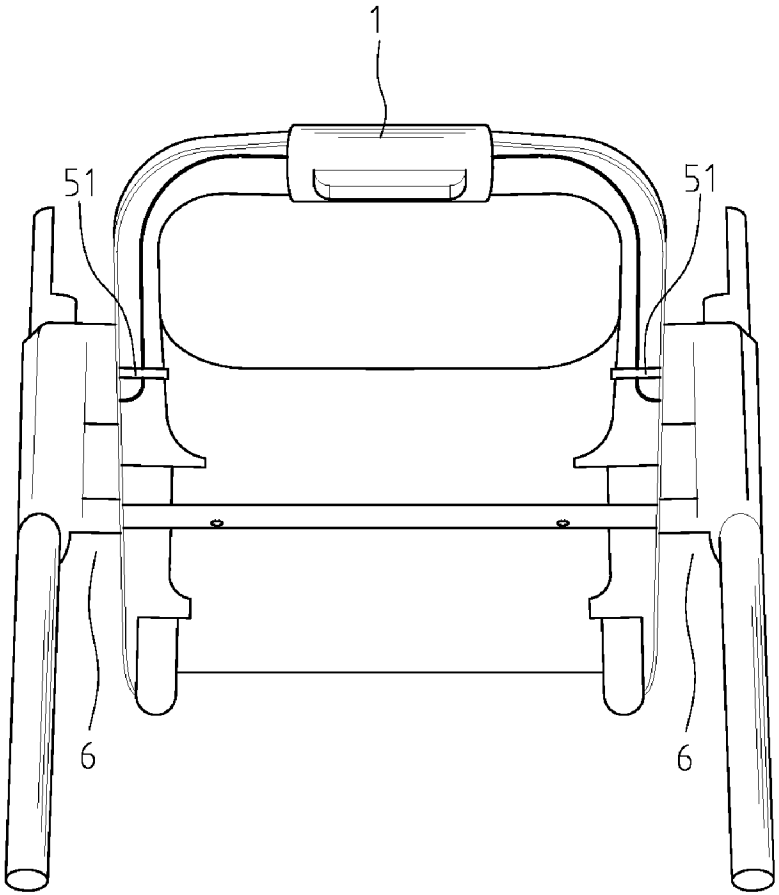
FIG. 5 is a schematic perspective view showing a height adjustment mechanism of a highchair according to a second embodiment of the present invention.

With reference to FIG. 5, the height adjustment mechanism of the highchair according to the second embodiment of the present invention comprises the handle-type operating unit 1 and the twisting locking unit 6.

Figure 6:
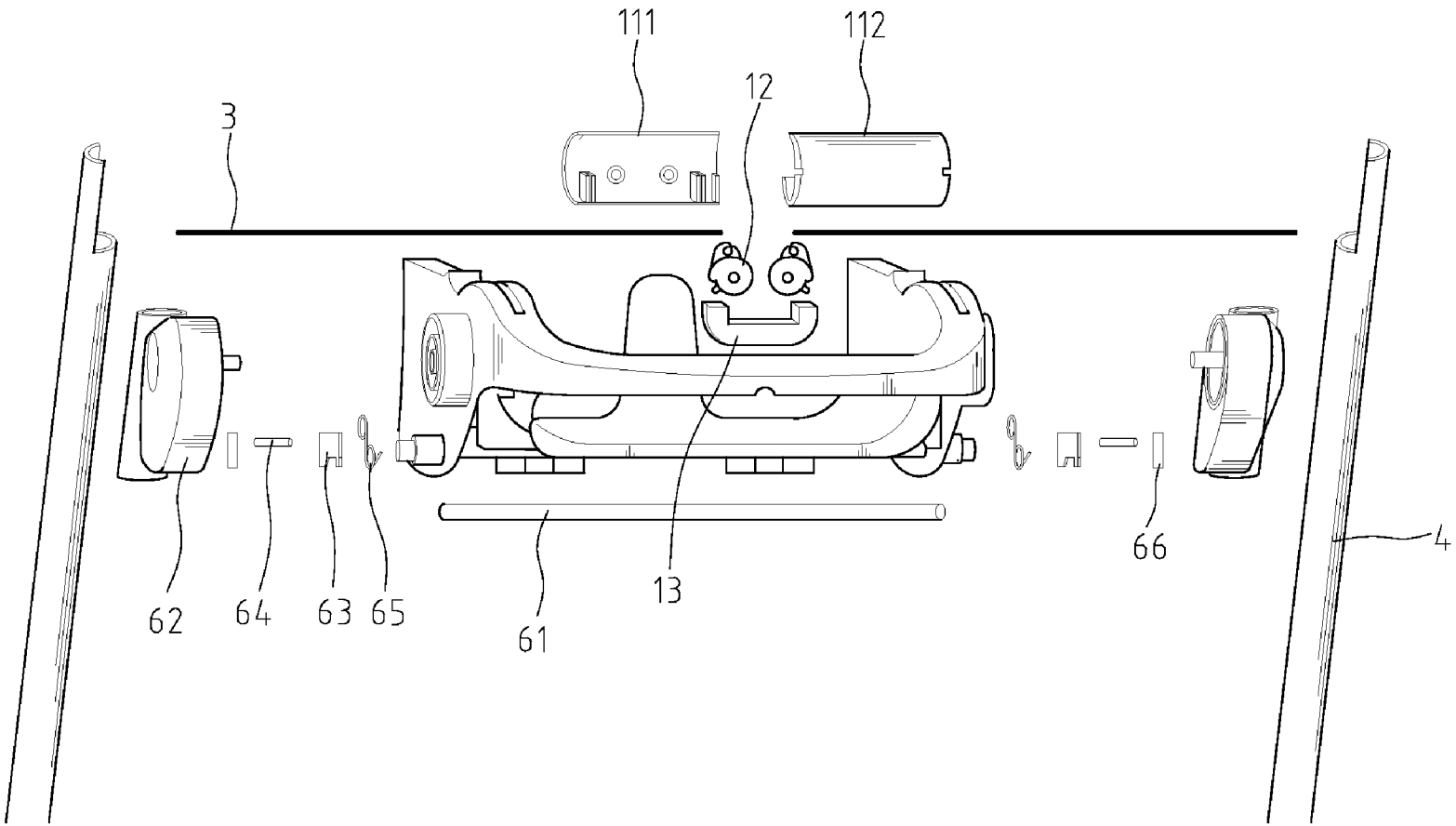
FIG. 6 is an exploded perspective view showing the height adjustment mechanism according to the second embodiment of the present invention.

FIG. 6 shows the height adjustment mechanism for a highchair according to the second embodiment of the present invention. The handle-type operating unit 1 includes the height adjusting housing 11 having the front housing 111 and the rear housing 112, the adjustment gears 12, and the handle 13. Also, the twisting locking unit 6 includes a seat positioning tubes 61, height adjustment members 62, fixing members 63, bolts 64, torsion springs 65, and positioning members 66. The handle-type operating unit 1 is connected with the twisting locking unit 6 by adjustment wires 3 and the height adjustment members 62 is movably connected with the front legs 4 to let the seat 5 to glide up and down.

Figure 7:
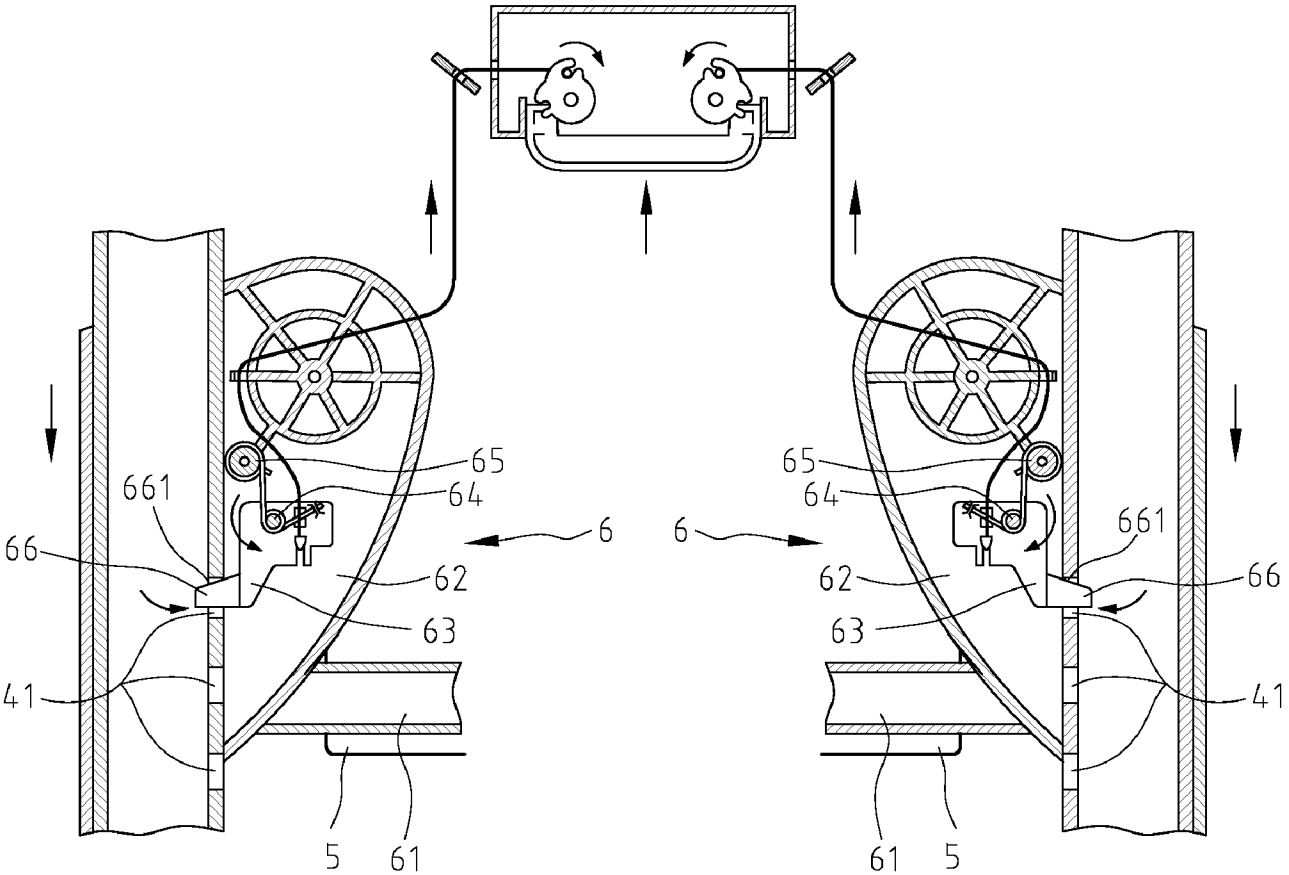
FIG. 7 is a cross-sectional view showing an unlocking process of the height adjustment mechanism according to the second embodiment of the present invention.

FIG. 7 is a cross-sectional view showing the height adjustment mechanism according to the second embodiment of the present invention. The handle-type operating unit 1 described in the first embodiment is connected with the twisting locking unit 6. The fixing members 63, the bolts 64, the torsion springs 65 and the positioning members 66 are disposed inside the height adjustment member 62. The seat positioning tube 61 is mounted between the height adjustment members 62. Further, the positioning member 66 is a board piece, and has an inclining surface at the front end thereof The positioning member 66 is connected with the fixing member 63, and the bolt 64 is the rotating pivot of the fixing member 63. Further, the bolt 64 is connected with the torsion spring 65. One end of the torsion spring 65 is connected with the fixing member 63 and the other end of the torsion spring 65 is fixed on the height adjustment member 62. Also, the fixing member 63 is connected with the adjustment wire 3 of the handle-type operating unit 1.

Referring to FIG. 7, when using the mechanism mentioned above to adjust the seat 5 to a lower position, first of all, the handle 13 of the handle-type operating unit 1 is pressed inward and the handle 13 drives the adjustment gears 12 to rotate. The adjustment wires 3 connected with the adjustment gears 12 are then driven to move inward by the adjustment gears 12. Referring to FIGS. 5 and 7, each adjustment wire 3 passes by the rivet 51 in the seat 5, enters the height adjustment member 62, and thus the adjustment wire 3 is able to pull the fixing member 63. The fixing member 63 is pulled to rotate the positioning member 66 away from the positioning hole 41, which makes the torsion spring 65 twisted, thereby temporarily disengaging the positioning member 66 from the positioning hole 41 of the front leg 4. The seat 5 is then free to move and can be adjusted to another position. As the seat 5 is adjusted to a lower proper position, the handle 13 is released so that the adjustment wires 3 are also released. The torsion springs 65 resume to the original state, and push the positioning members 66 back to the positioning holes 41 of the front legs 4, thereby engaging the positioning members 66 with the front legs 4. Therefore, it completes the height adjustment of the seat 5 to a lower position. At the moment, the positioning members 66 are inserted into the positioning holes 41, the adjustment wires 3 are pulled by the positioning members 66, the adjustment gears 12 are driven by the wires 3 and the handle 13 are driven by the adjustment gears 12 back to the original un-pressed state. To adjust the seat 5 to a higher position, it does not need to press the handle 13 and only need to raise the seat 5 upward directly. When the seat remains on a height position, the positioning members 66 engage with the positioning holes 41 and the rims of the positioning holes 41 are contacted with the inclining surfaces 661 at the front ends of the positioning members 66. When the seat 5 is raised, the inclining surfaces 661 of the positioning members 66 slide against the opening of the positioning holes 41. Thus, the positioning members 66 rotate into the height adjustment members 62 and twist the torsion springs 65. At the time, the positioning members 66 temporarily disengage from the positioning holes 41 of the front legs 4, so the seat 5 is free to move. When the seat is raised to a higher position and the positioning members 66 arrive at new positioning holes 41, the torsion springs 65 resume to the original state and push the positioning members 66 into to the new positioning holes 41. Thus, the positioning members 66 engage with the positioning holes 41 of the front legs 4 again. Therefore, it completes the height adjustment of the seat 5 to a higher position.

Figure 8:
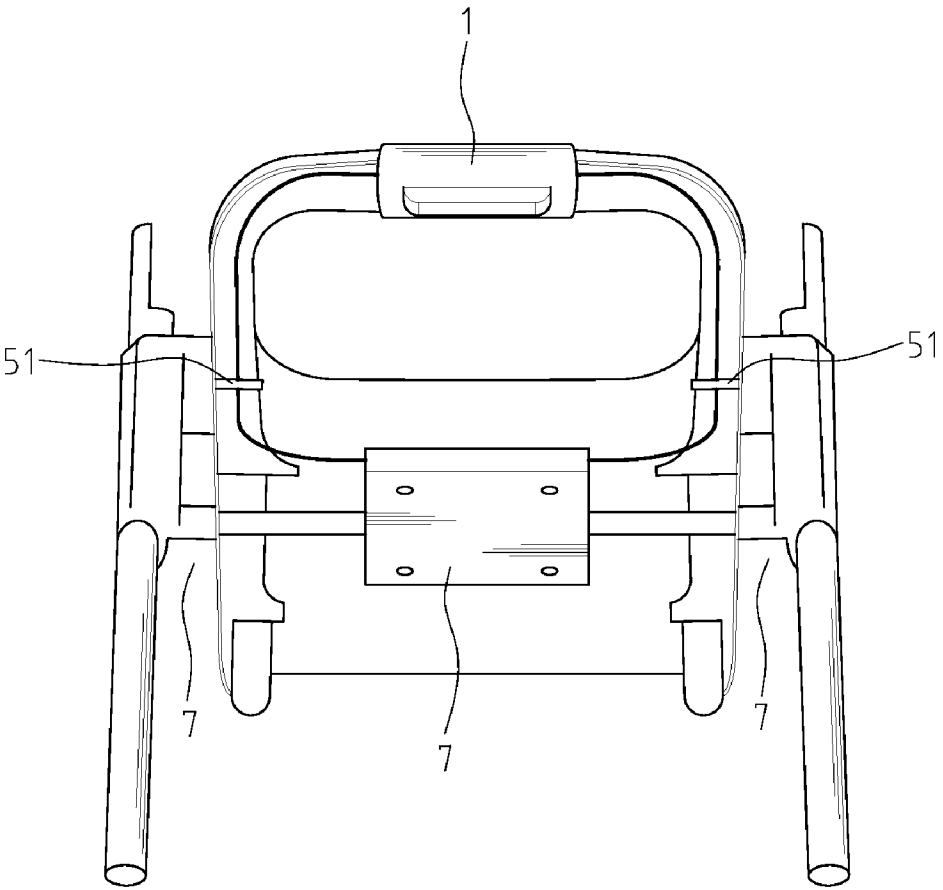
FIG. 8 is a schematic perspective view showing a height adjustment mechanism of a highchair according to a third embodiment of the present invention.

With reference to FIG. 8, the height adjustment mechanism according to the third embodiment of the present invention includes the handle-type operating unit 1 and the slanting locking unit 7.

Figure 9:
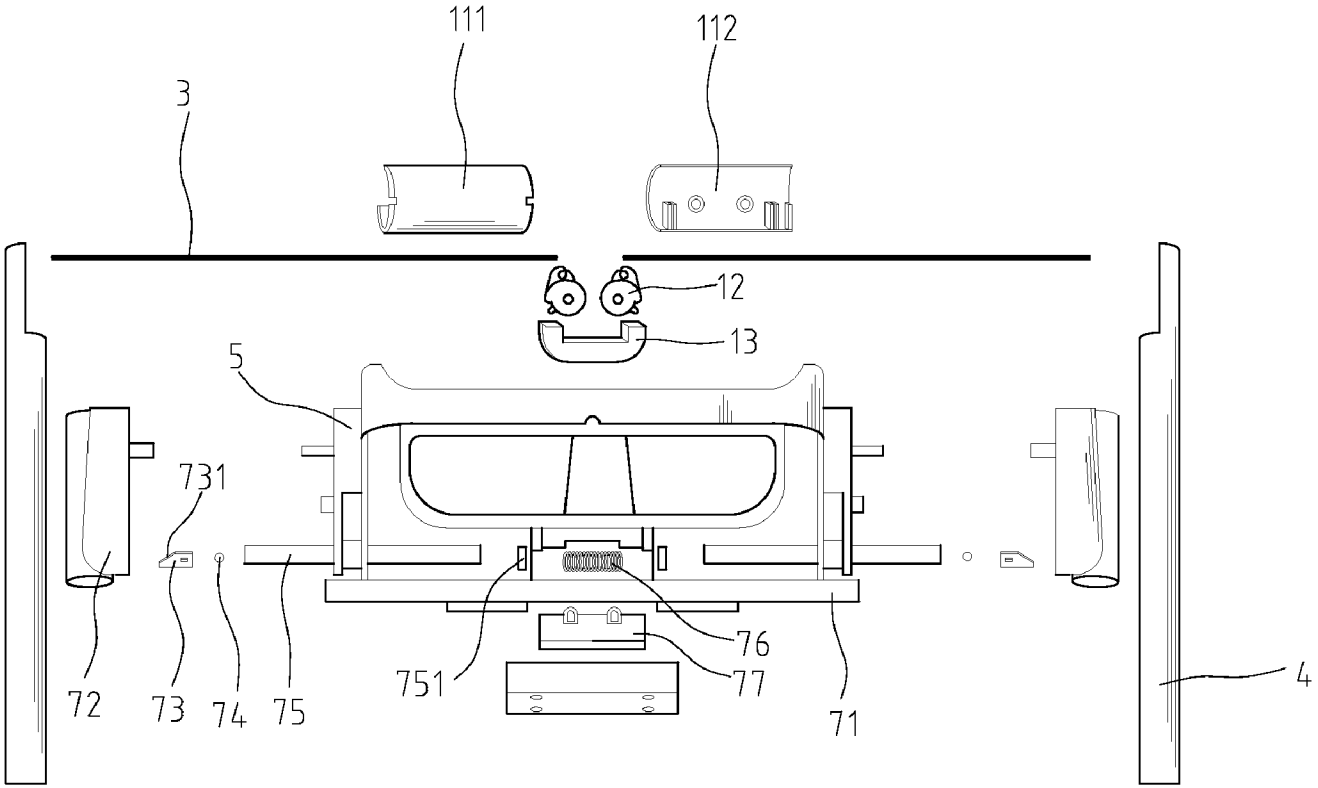
FIG. 9 is an exploded perspective view showing the height adjustment mechanism according to the third embodiment of the present invention.

FIG. 9 is an exploded perspective view showing the height adjustment mechanism according to the third embodiment of the present invention. The height adjustment mechanism in this embodiment has a handle-type operating unit 1 and a slanting locking unit 7. The handle-type operating unit 1 includes the height adjusting housing 11 having the front housing 111 and the rear housing 112, the adjustment gears 12, and the handle 13. Also, the slanting locking unit 7 includes a seat positioning tube 71, height adjustment members 72, positioning members 73, pins 74, fixing members 75, groove pins 751, a spring 76, a driving member 77, and a driving member cover 78. The handle-type operating unit 1 is connected with the slanting locking unit 7 by adjustment wires 3 and the height adjustment members 72 are movably connected with the front legs 4 to let the seat 5 to glide up and down.

Figure 10:
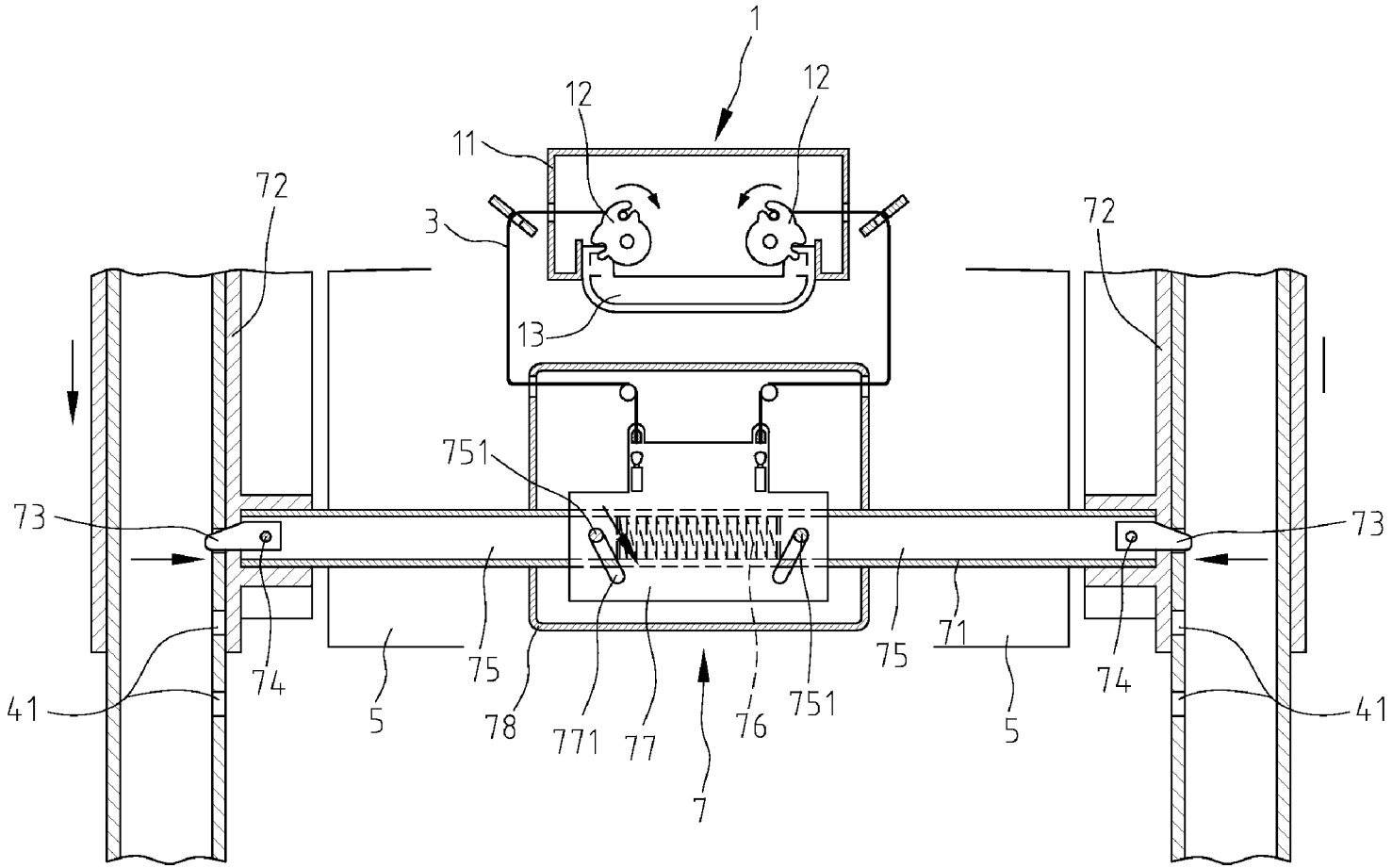
FIG. 10 is a cross-sectional view showing an unlocking process of the height adjustment mechanism according to the third embodiment of the present invention.

FIG. 10 shows the height adjustment mechanism according to the third embodiment of the present invention. The handle-type operating unit 1 as described in the first embodiment is connected with the slanting locking unit 7. Also, for the slanting locking unit 7, the positioning members 73, the pins 74, the fixing members 75, and the spring 76 are disposed inside the seat positioning tube 71. The height adjustment members 72, the driving member 77, and the driving member cover 78 are disposed outside of the seat positioning tube 71. The seat positioning tube 71 is mounted between the height adjustment members 72. Further more, the positioning member 73 is a board piece and has an inclining surface at the front end thereof. The positioning member 73 is connected with the fixing member 75 by means of the pin 74. The spring 76 is disposed between the fixing members 75. The side of the fixing member 75 close to the spring 76 provides a groove pin 751 thereon, and the groove pin 751 is inserted into a slant groove 771 of the driving member 77. Two top ends of the driving member 77 are connected with the adjustment wires 3 of the handle-type operating unit 1, respectively. Also, the driving member cover 78 covers on the driving member 77.

When using the mechanism mentioned above to adjust the seat 5 to a lower position, first of all, the handle 13 of the handle-type operating unit 1 is pressed inward and drives the adjustment gears 12 to rotate simultaneously. The adjustment wires 3 connected with the adjustment gears 12 are then driven to move inward by the adjustment gears 12. Each adjustment wires 3 pass by the rivet 51 in the seat 5 (with reference to FIG. 8) and enter the driving member cover 78. Thus the adjustment wires 3 are able to pull the driving member 77 upward. Further, the groove pins 751 are movably inserted in the slant grooves 771. When the driving member 77 is pulled upward, the groove pins 751 are forced to glide along the slant grooves 771. The groove pins 751 make the fixing members 75 to approach each other, which also makes the spring 76 compressed, and thereby the positioning members 73 temporarily disengage from the positioning holes 41 of the front legs 4. Therefore, the seat 5 can be adjusted to a lower position. As the seat 5 is moved to a lower position, releasing the handle 13 so that the driven adjustment wires 3 are also released. The spring 76 resumes to its original state for the adjustment wire 3 being released, and then pushes the positioning members 73 back to the positioning holes 41 of the front legs 4, thereby engaging the positioning members 73 with the front legs 4. Therefore, it completes the height adjustment of the seat 5 to a lower position. At the same time, because the positioning members 73 are engaged into the positioning holes 41, the adjustment wires 3 pulled by the positioning members 73 drive the adjustment gears 12, and the adjustment gears 12 drive the handle 13 back to the original state. On the other hand, if it needs to adjust the seat 5 to a higher position, it does not need to press the handle 13 and only has to raise the seat 5 upward directly. When the seat remains on a height position, the positioning members 73 engage with the positioning holes 41 and the rims of the positioning holes 41 are contacted with the inclining surfaces at the front ends of the positioning members 73. When the seat 5 is raised, the inclining surfaces of the positioning members 73 slide against the opening of the positioning holes 41 and the positioning members 73 glide into the seat positioning tube 71, which makes the positioning members 73 compress the spring 76. Thus, the positioning members 73 temporarily disengage from the positioning holes 41 of the front legs 4 and the seat 5 is then free to move. When the seat 5 is raised to a higher position and the positioning members 73 arrive at new positioning holes 41, the spring 76 resumes to the original state and push the positioning members 73 into to the positioning holes 41. Thus, the positioning members 73 engage with the positioning holes 41 of the front legs 4 again. Therefore, it completes the height adjustment of the seat 5 to a higher position.

FIG. 11 shows the height adjustment mechanism for a highchair according to another embodiment of the present invention. The height adjustment mechanism in this embodiment includes a button-type operating unit 10 and the locking unit as described above. The button-type operating unit 10 includes a button 101 disposed on a backrest of the seat 5. The button 101 is connected with adjustment wires 3 to drive the locking unit, such as the linear locking unit 1 (with reference to FIG. 4), the twisting locking unit 6 (with reference to FIG. 7) or the slanting locking unit 7 (with reference to FIG. 10) to lock or unlock the movement of the seat 5. Further more, a spring 102 is disposed in the button 101.

Figure 12:
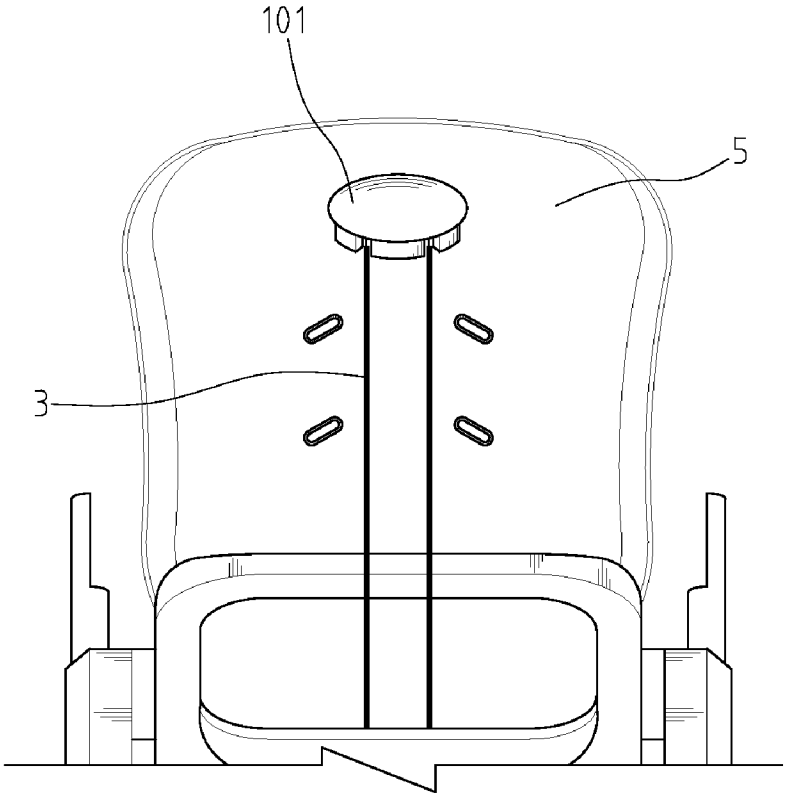
FIG. 12 is a schematic view showing an unlocking state of the operating unit according to another embodiment of the present invention.

FIG. 12 is a schematic view showing the button-type operating unit 10 according to another embodiment of the present invention. When using the button-type operating unit 10 to adjust the seat 5 to a lower position, first of all, pull the button 101 of the button-type operating unit 10 upward. The adjustment wires 3 connected to the button 101 are then pulled upward together with the locking unit, such as the linear locking unit 1, the twisting locking unit 6 or the slanting locking unit 7. The interaction between the adjustment wires 3 and the linear locking unit 1, the twisting locking unit 6, or the slanting locking unit 7 is the same as those described in the first, second, and third embodiments, respectively. Thus, the height of the seat 5 can be adjusted. On the other hand, if it needs to adjust the seat 5 to a higher position, it does not need to pull the button 101 but only need to raise the seat 5 upward directly. The method for raising the seat 5 is the same as those described in the first, second, and third embodiments.

Figure 13:
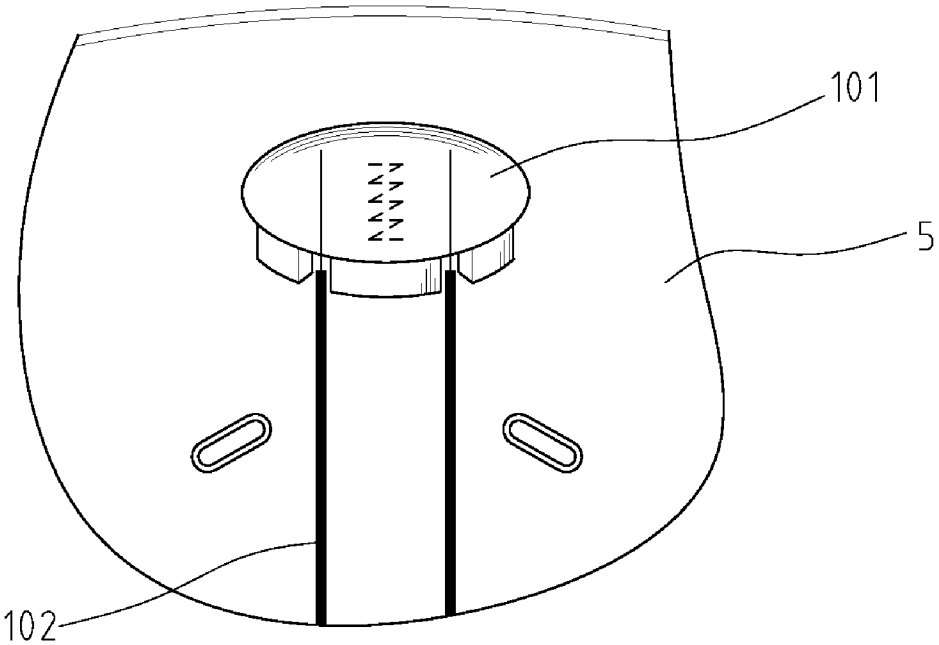
FIG. 13 is a schematic view showing that the operating unit is returning to an original state according to another embodiment of the present invention.

With reference to FIGS. 11, 12, and 13, the button-type operating unit 10 includes the spring 102 beneath the button 101. After the pulling on the button 101 is released, the spring 102 resumes to its original state and makes the button 101 return to the original state.

The seat comprises a seat portion, a backrest portion pivotally connected with the seat portion, and a U-shape rail portion extended from the backside of the seat. The backrest portion is adjustable to recline at various angles relative to the seat portion. The operating member can be disposed on the rail portion or on the backrest portion.

To summarize from above description, the single-hand height adjustment mechanism according to the present invention includes an operating unit handled with a single hand, and a locking unit connected with the operating unit. All the operations of the operating units are simple and easy, such as handle pressing or button pulling, to pull the adjustment wires. Therefore, the seat can be adjusted to a higher or lower position with the use of a single hand.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A single-hand height adjustment mechanism of a highchair, which comprises a pair of supporting tubes having a plurality of positioning holes, and a seat disposed between the supporting tubes, comprising:

an operating unit disposed on the seat and provided with an operating member, and a return member connected to the operating member for returning the operating member back to an original state; and a locking unit comprising a pair of height adjustment members disposed at both sides of the seat and being capable of gliding along the supporting tubes respectively, and a pair of positioning members adjacent to the height adjustment members and respectively connected with the operating member by connecting members;

wherein the return member is a gear connected with the operating member, the connecting member is connected between the gear and the positioning member, and the locking unit further comprises an elastic member for biasing the positioning member to couple with one of the positioning holes of the corresponding supporting tube.

2. The height adjustment mechanism as claimed in claim 1, wherein the positioning member has an inclining surface to contact with a rim of the corresponding positioning hole with which the positioning member couples.

3. The height adjustment mechanism as claimed in claim 1, wherein the connecting member is a metal wire.

4. The height adjustment mechanism as claimed in claim 1, wherein the operating member is a handle.

5. The height adjustment mechanism as claimed in claim 1, wherein the operating member is a button.

6. The height adjustment mechanism as claimed in claim 1, wherein the elastic member is a spring.

7. The height adjustment mechanism as claimed in claim 1, wherein the seat is fixed with a seat positioning tube that is connected between the pair of the height adjustment members, the positioning member and the elastic member are disposed in the seat positioning tube.

8. The height adjustment mechanism as claimed in claim 1, wherein the supporting tubes comprise front legs of the highchair and the positioning holes are disposed on the front legs.

9. The height adjustment mechanism as claimed in claim 1, wherein the locking unit further comprises a seat positioning tube disposed between the height adjustment members and a pair of fixing members disposed in each of the opposite two ends of the seat positioning tube; the positioning member is connected with the fixing member and the fixing member is connected with the gear by the connecting members.

10. The height adjustment mechanism as claimed in claim 1, wherein the locking unit comprises a pair of fixing members respectively pivotally connected to the pairs of height adjustment members and the two positioning members respectively connected with the fixing members; the elastic member is a torsion spring disposed at a pivot position where the fixing member connects with the height adjustment member; one end of the torsion spring is connected with the fixing member and the other end of the torsion spring is connected with the height adjustment member.

11. The height adjustment mechanism as claimed in claim 1, wherein the locking unit further comprises a seat positioning tube disposed between the height adjustment members, a driving member mounted on the seat positioning tube and connected with and operated by the connecting members, and two fixing members respectively secured to the pair of positioning members, disposed in the opposite two ends of the seat positioning tube, and driven to move toward each other by the driving member.

12. A highchair, comprising:

a pair of front legs, each of which includes a plurality of positioning holes;

a pair of rear legs connected with the front legs;

a seat disposed between the front legs; and an adjustment mechanism for adjusting the position of the seat relative to the front legs, comprising:

an operating unit disposed on the seat and comprising an operating member; and a locking unit, comprising a pair of height adjustment members disposed at both sides of the seat and capable of moving along the front legs respectively, and a pair of positioning members adjacent to the height adjustment member, connected with the operating member by connecting members, and capable of being moved between a locking position and an unlocking position;

wherein as the positioning member is in the locking position, each positioning member couples with one of the positioning holes on the corresponding front leg; as the operating member drives the positioning members to the unlocking position, the height adjustment members are capable of being moved along the front legs, thereby adjusting the relative position between the seat and the front legs, the seat comprises a seat portion and a backrest portion pivotally connected with the seat portion, and the operating member is disposed on the backrest portion.

13. A highchair, comprising:

a pair of front legs, each of which includes a plurality of positioning holes;

a pair of rear legs connected with the front legs;

a seat disposed between the front legs; and an adjustment mechanism for adjusting the position of the seat relative to the front legs, comprising:

an operating unit disposed on the seat and comprising an operating member; and a locking unit, comprising a pair of height adjustment members disposed at both sides of the seat and capable of moving along the front legs respectively, and a pair of positioning members adjacent to the height adjustment member, connected with the operating member by connecting members, and capable of being moved between a locking position and an unlocking position;

wherein as the positioning member is in the locking position, each positioning member couples with one of the positioning holes on the corresponding front leg; as the operating member drives the positioning members to the unlocking position, the height adjustment members are capable of being moved along the front legs, thereby adjusting the relative position between the seat and the front legs, the seat comprises a seat portion, a backrest portion pivotally connected with the seat portion, and a U-shape rail portion extended from the backside of the seat, and the operating member is disposed on the rail portion.

14. The highchair as claimed in claim 13, wherein the locking unit further comprises a seat positioning tube positioned at a bottom of the seat portion and disposed between the height adjustment members; the pair of the positioning members are movably mounted within each of the opposite ends of the seat positioning tube.

15. The highchair as claimed in claim 13, wherein the pair of positioning members is movably connected to the pair of height adjustment members respectively, whereby the positioning members are movable between the locking position and the unlocking position.

* * * * *